United States Patent [19]

Rülke

[11] Patent Number: 4,953,686

[45] Date of Patent: Sep. 4, 1990

[54] BALUSTRADE FOR A TRANSPORTATION APPARATUS ESPECIALLY AN ESCALATOR OR A PASSENGER WALKWAY

[75] Inventor: Gerhart Rülke, Vienna, Austria

[73] Assignee: Inventio AG, Hergiswil, Switzerland

[21] Appl. No.: 375,741

[22] Filed: Jul. 5, 1989

[30] Foreign Application Priority Data

Jul. 11, 1988 [CH] Switzerland ..... 02645/88

[51] Int. Cl.[5] ..... B66B 23/22

[52] U.S. Cl. ..... 198/332; 198/335; 198/326

[58] Field of Search ..... 198/332, 335, 333, 326, 198/337

[56] References Cited

U.S. PATENT DOCUMENTS

| | | | |
|---|---|---|---|
| 2,813,613 | 11/1957 | Margles | 198/332 |
| 3,144,118 | 8/1964 | Fabula | 198/332 |
| 3,595,364 | 7/1971 | Schoneweiss | 198/335 |
| 4,175,653 | 11/1979 | Kubota et al. | 198/335 X |
| 4,249,649 | 2/1981 | Kraft | 198/332 |
| 4,488,631 | 12/1984 | Courson . | |

FOREIGN PATENT DOCUMENTS

| | | | |
|---|---|---|---|
| 1274286 | 8/1968 | Fed. Rep. of Germany . | |
| 2548651 | 5/1976 | Fed. Rep. of Germany . | |
| 3709637 | 10/1987 | Fed. Rep. of Germany . | |
| 1512084 | 2/1968 | France | 198/335 |
| 2467813 | 4/1981 | France . | |
| 0077382 | 6/1977 | Japan | 198/335 |
| 0140382 | 10/1979 | Japan | 198/335 |
| 0140384 | 10/1979 | Japan | 198/335 |
| 0672135 | 6/1979 | U.S.S.R. | 198/335 |
| 2006706 | 5/1979 | United Kingdom | 198/335 |

*Primary Examiner*—David A. Bucci
*Assistant Examiner*—D. Glenn Dayoan
*Attorney, Agent, or Firm*—Werner W. Kleeman

[57] ABSTRACT

The balustrade for transportation apparatus, such as an escalator or a moving passenger walkway contains upright balustrade panels directly laterally guiding tread elements, such as steps or tread plates so as to dispense with both of the conventionally employed inner balustrade decks with their associated inner deck covers. A respective stable support profile member connected with a support body and arranged at both sides of a transport element, such as a step or tread plate band receives the base of the associated balustrade panel. The heads of screws or threaded bolts required for fastening the associated balustrade panel are arranged countersunk in openings of such balustrade panel. Apart from the savings in cost realized with the invention it is also possible to reduce the entire structural width of the transportation apparatus. Due to the elimination of the inner balustrade deck the step or tread plate band also can be arranged at an elevated position in relation to the outer balustrade deck, so that when using glass balustrades there is visibly discernible the movement and especially the direction of movement of the step or tread plate band from both external sides of the transportation apparatus.

11 Claims, 4 Drawing Sheets

BALUSTRADE FOR A TRANSPORTATION APPARATUS ESPECIALLY AN ESCALATOR OR A PASSENGER WALKWAY

BACKGROUND OF THE INVENTION

The present invention broadly relates to transportation or transport apparatus and, more specifically, is concerned with a new and improved balustrade for an escalator or a moving passenger walkway.

In its more specific aspects, the invention is directed to a new and improved construction of a balustrade for a transportation apparatus, such as an escalator or a moving passenger walkway, which is of the type comprising a support body or body member, two balustrade side walls constructed as glass plates. These balustrade side walls are arranged laterally inwardly of the support body or body member. Each of the balustrade side walls is provided with an associated movable handrail. There is also provided a transport means or element, such as an endless revolvingly driven step or tread plate band disposed between the balustrade side walls, an outer cover or cover means and at least one outer deck or sill cover at both sides of the outer cover or cover means and interconnecting the balustrades.

Two primary types of balustrades are conventionally employed in conjunction with escalators and moving passenger walkways. A more old-fashioned construction of balustrade comprises outer and inner cover or lining elements which extend almost to the height of a movable handrail. These outer and inner cover elements are interconnected by a handrail cover profile member in which there is also integrated the guide profile or member for the handrail. The inner cover plates or panels arranged at the side of the steps are disposed vertically or upright at the region of the step or conveyor band, whereas the connection plates or panels situated above the first-mentioned cover plates or panels and which merge at the handrail cover profile or member can be slightly inclined or possess a concave or convex curvature.

A further more recent construction of balustrade comprises a respective vertical or upright glass or compound plate or panel which extends in lengthwise direction at both sides of the step or conveyor band. Each such respective vertical glass or compound plate carries at the upper side thereof a handrail guide profile or member and at the lower side is clamped in a vice-like manner in a balustrade deck or sill which covers the attachment elements of the plates or panels at both sides of such plates or panels. The balustrade deck or sill comprises an outer sheet metal or profile cover which in cross-section is generally horizontally arranged and an inner sheet metal or profile cover arrangement. This inner cover arrangement is vertically disposed at the region of the step or the conveyor band and between the step band and the vertical plates or panels inclinedly descends in the direction of the step band.

A balustrade constructed in accordance with the last-mentioned design has been disclosed in FIG. 1 of the German Patent Publication No. 3,709,637, published Oct. 1, 1987. That patent document teaches a multi-function glass plate holder for an escalator balustrade. FIG. 1 depicts a cross-sectional view of one side of a transportation apparatus with the balustrade equipped with the inventive glass holder. There is also taught the provision of a glass plate which carries at its upper side the handrail guide member and the handrail.

At the lower side of the glass plate there is provided a horizontally extending cover profile or member which covers from the outside the glass holder situated at a greater elevation in relation to the upper edge of the steps. An inclined cover profile or member located at the side of the steps covers the glass holder from the inside. The outer horizontal cover member and the inner inclined cover member in conjunction with an upright or vertical cover member or lining arranged laterally adjacent the steps collectively form a balustrade deck or sill which extends along both sides of the glass plate.

A drawback of such escalator balustrade construction resides in the fact that it requires that both sides have a respective inner deck or sill and an inner deck or sill cover. As a consequence thereof the total width of the escalator or moving stairway, with the same width of the steps and the same passenger conveying capacity, is relatively large.

SUMMARY OF THE INVENTION

Therefore, with the foregoing in mind, it is a primary object of the present invention to provide a new and improved construction of balustrade for transportation apparatus, especially an escalator or a moving walkway, which is not afflicted with the aforementioned drawbacks and limitations of the prior art.

Another and more specific object of the present invention is directed to an improved construction of balustrade for escalators or moving passenger walkways, by means of which the total width of the escalator or moving passenger walkway, with constant step or conveyor band width or with constant passenger conveying capacity, can be reduced, and such construction affords a saving in deck or sill cover elements and imparts a total visual impression of a less massive escalator or a less massive moving walkway.

Now in order to implement these and still further objects of the invention, which will become more readily apparent as the description proceeds, the balustrade of the present development is manifested, among other things, by the features that each of the balustrade side walls comprises upright or substantially vertically arranged balustrade panels or plates which laterally guide the transport means or element, such as the step or tread plate band. The spacing between the balustrade panels is only slightly larger than the width of the tread or treadable elements, here the steps or the tread plates, and the step or tread plate band at the treadable inbound region of the transportation apparatus is protrudingly arranged in relation to the outer deck cover means or arrangement.

Certain of the more notable advantages of the present invention essentially reside in the fact that by virtue of the direct guidance of the tread or treadable elements, namely the steps or the tread plates at the upright or substantially vertically oriented balustrade panels there can be dispensed with the use, as was heretofore the case with prior constructions, of the inner deck or sill at both sides adjacent to the steps or tread plates. As a result there is realized a beneficial saving in a part of the total width of the structure of the escalator or the moving passenger walkway. Due to the elimination of the inner cover elements of the balustrade deck or sill there is also simultaneously realized a reduction in the fabrication costs of the transportation apparatus. A further advantage also resides in the fact that there cannot arise any dangerous transition locations between the upright or vertical deck and an inner slightly inclined deck cover, thus eliminating a possible source of danger where accidents could occur due to passengers being unintentionally clamped or entrapped.

A further advantage also resides in the fact that by dispensing with the inner deck cover of escalators the treadable inclined step band can be arranged at a greater elevation or height in relation to the outer deck cover, so that when using glass balustrades a part of the moved step band is also visible from externally of the escalator or, stated somewhat differently, there is always visible from externally of the escalator the front edge region or nose portion of each individual step. On the one hand, the potential passenger is thus able to visually discern from a distance the escalator which is in operation and, in particular, can visually observe the direction of travel of such operating escalator. On the other hand, by virtue of the lower positioned outer balustrade, in other words due to a reduction in the height of the lower support structure, there is obtained the esthetic or optical impression of a less massive escalator.

BRIEF DESCRIPTION OF THE DRAWINGS

The invention will be better understood and objects other than those set forth above will become apparent when consideration is given to the following detailed description thereof. Such description makes references to the annexed drawings wherein have been generally used the same reference characters to denote the same or analogous components and wherein.

DESCRIPTION OF THE PREFERRED EMBODIMENTS

Figure 1:
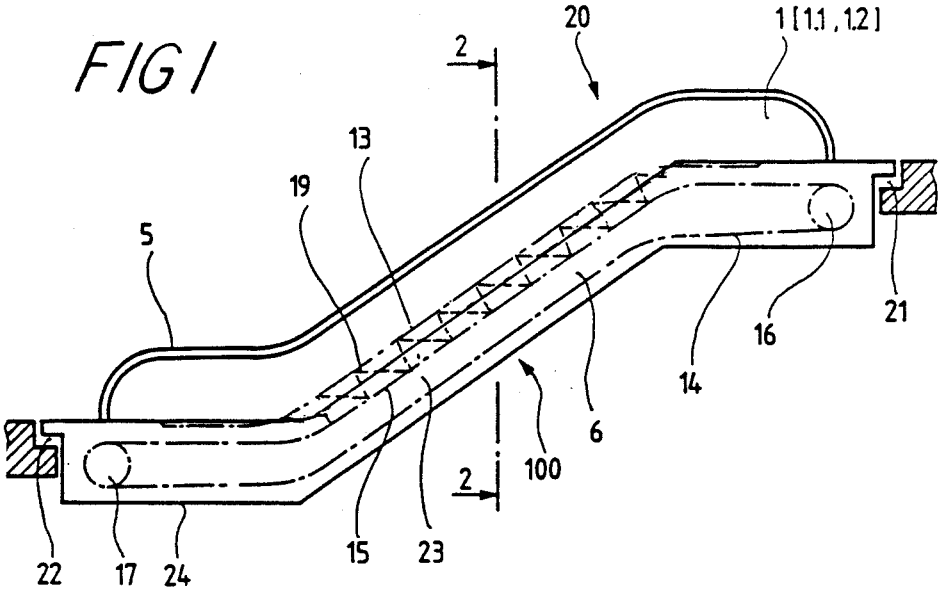
FIG. 1 is a side view of a transportation or transport apparatus constructed according to the invention, here shown in the form of an escalator or moving stairway mounted upon an upper support and a lower support present at different landings.

Describing now the drawings, it is to be understood that only enough of the construction of the transportation or transport apparatus has been shown therein as needed for one skilled in the art to readily understand the underlying principles and concepts of the present development, while simplifying the illustration of the drawings. Turning attention now to the first exemplary embodiment of FIGS. 1, 2 and 3, there will be recognized a transportation or transport apparatus 100 which is here shown only by way of example, and not limitation, in the form of an escalator or moving stairway 20 provided with the upright or substantially vertically extending or oriented balustrades, denoted in FIG. 1 by reference numeral 1, located at opposite sides of the escalator 20 as is well known in this art. Furthermore, this escalator 20 is mounted upon an upper support or support member 21 and a lower support or support member 22 of a suitable building or structure, these supports 21 and 22 being typically located at different landings. Each balustrade 1 comprises a balustrade side wall, the balustrade side wall located at the left side of FIG. 2 being designated by reference numeral 1.1 and the balustrade side wall located at the right side of such FIG. 2 being designated by reference numeral 1.2. Each of these balustrade side walls 1.1 and 1.2 is located adjacent a revolving transport means or element or band member 15 constituting, as the case may be, a step or tread plate band or band member.

In the illustrated exemplary embodiment each balustrade side wall 1.1 and 1.2 comprises a substantially upright or vertically arranged balustrade panel or plate 2, for instance formed of safety glass having an adequate glass thickness, a handrail support member or profile 3, a handrail guide member 4 and an endless revolving handrail 5. Each balustrade panel 2 is secured at an associated stable support member or profile 7 by suitable fastening expedients, such as the depicted threaded screws or bolts 9 and nut members 10. Each such stable support member or profile 7 is connected by a support element 8, for instance formed of sheet metal, with a support body member or body 6. The heads 9*a* of the threaded screws or bolts 9 are counter-sunk in the associated balustrade panel or plate 2 and possess an underlay liner or washer 28 which is appropriately configured in relation to the counter-sunk bore or portion 9*b* receiving the counter-sunk head 9*a* of the associated threaded screw or bolt 9.

Continuing, each support member or profile 7 additionally serves for retaining or supporting the associated handrail guide member 4 at the return region or run of the handrail 5, for receiving an outer deck or sill cover or cover member 11, as a counter guide 7.1 for the chain rolls or rollers 12 of a step chain 14 which interconnects the individual tread or treadable elements, here steps 13 or equivalent structure with one another and is also capable of receiving within a longitudinal channel 7.2 lighting elements and light-transparent cover elements, generally indicated by reference character 7.3, for the illumination of the associated balustrade panel or panel structure 2. The individual tread elements, here for instance the steps 13, are guided at both sides by an associated slide guide 25 directly at the balustrade panels 2 between the left balustrade side wall 1.1 and the right balustrade side wall 1.2. The steps 13 or, in the case of moving passenger walkways, tread plates are assembled together into an endless transport means or element, here a step band or band member 15 by the step chains or chain members 14 arranged at both sides. Each endless step band 15 is trained about an associated upper drive wheel 16 and a lower deflection wheel 17. It is to be, of course, understood that in the case of a moving passenger walkway the transport means or element defines a tread plate band or band member 15 which interconnects the tread plates by the chains or chain members 14.

Figure 3:
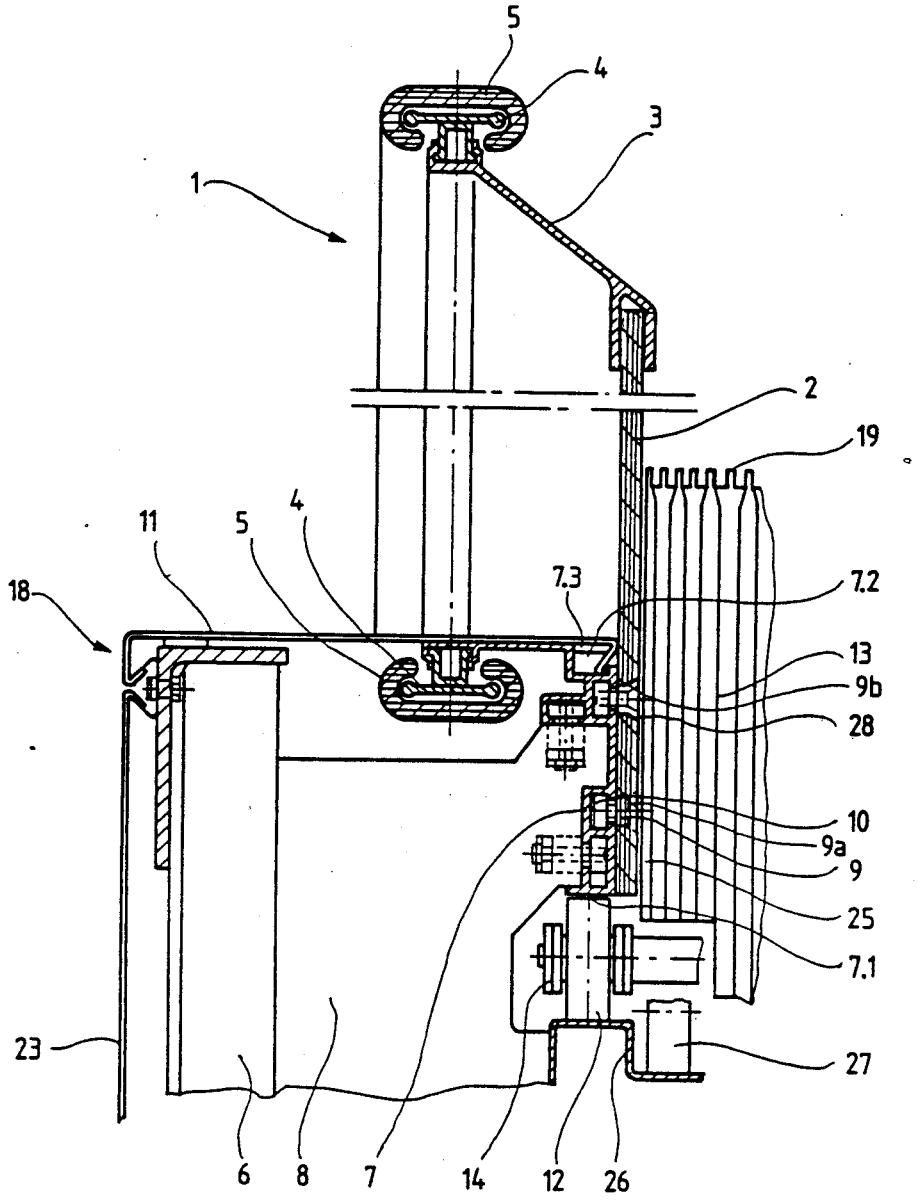
FIG. 3 is an enlarged detail of a balustrade deck or sill at the region encircled and designated by reference character 3 in FIG. 2.

It is also to be observed, particularly by referring to FIG. 3, that the chain rolls or rollers 12 of the step chain 14 travel upon support guides or guide members 26 which at the same time also accommodate travel rolls or rollers 27 of the individual steps 13. At the inclined part of the treadable inbound region or forward run of the step band 15 there are arranged outer lateral balustrade decks or sills 18 having the deck or sill covers or cover members 11. These outer lateral balustrade decks 18 are arranged at a lower position or location in relation to the step band or band member 15 in such a fashion that the step noses or front edges 19 of the tread elements, such as the steps 13 or, in the case of a moving passenger walkway, the upper portion of the tread plates, protrude in relation to the upper edge of the outer deck covers 11. With the illustrated exemplary embodiment employing glass balustrades 1 there is thus beneficially possible the visual observance of the movement of the step band 15 also from the exterior or outer side of the transportation or transport apparatus, here the depicted escalator 20. A respective outer cover 23 arranged at both sides at the support body member 6 and a lower cover or cover member 24 arranged at the lower side of the support body member 6 completely cover the support body member 6.

The support members or profiles 7 are adjustably attached by the sheet metal support elements 8 at the support body member 6, so that they engagingly receive the balustrade panels or plates 2 which simultaneously laterally guide the step band or band member 15. As previously explained, the balustrade panels or plates 2 are attached by threaded screws or bolts 9 and nut members 10 at the support members or profiles 7, and the counter sunk bores **9*b* provided at the balustrade panels or plates 2 and serving to receive the heads 9*a* of the threaded screws or bolts 9 or the like are protected by appropriately configured washers 28** or the like, for instance formed of a hard plastic material.

The slide guides or guide members 25 provided at both sides of the steps 13 or, as the case may be, the tread plates prevent these steps or thread plates from scraping against the balustrade panels 2. The lower bent portion of each support member or profile 7 serves as a counter guide 7.1 for the related chain rolls or rollers 12 which carry the step chain 14 or, as the case may be, the tread plate chain through its endless revolving path of travel. The chain rolls 12 roll upon the associated support guide or guide member 26 upon which also travels the travel rolls 27 of the steps 13. The upper flexed or bent part of each support profile 7 carries, on the one hand, the associated outer deck cover or cover member 11 and, on the other hand, the associated handrail guide or guide member 4 for the return run of the handrail 5 within the associated outer balustrade deck or sill 18.

Figure 2:
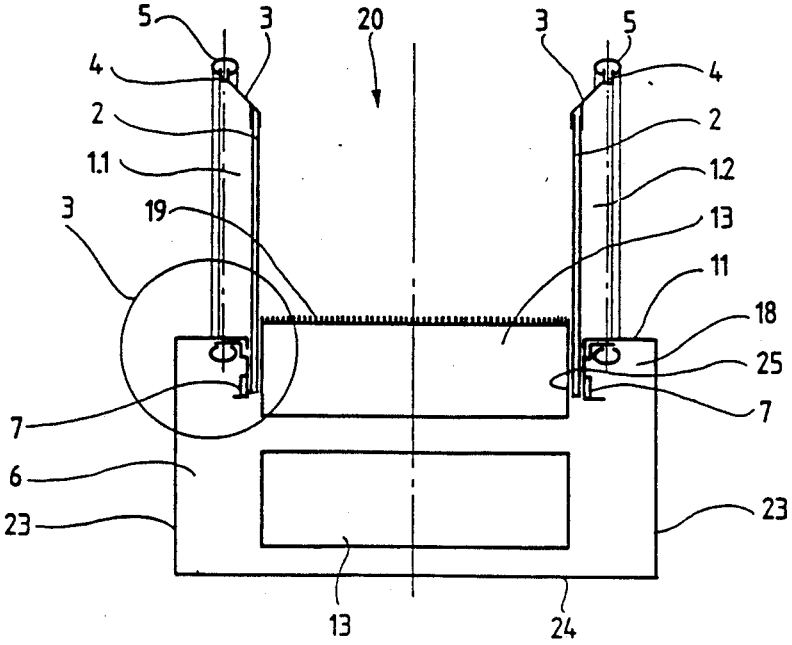
FIG. 2 is an enlarged cross-sectional view of the escalator depicted in FIG. 1, taken substantially along the section line 2—2 thereof.

In the embodiment of FIGS. 1 to 3, to ensure that the handrail 5 during its return travel can pass at a suitable distance parallel to the base of the associated balustrade panel or plate 2 and the related support element or profile 7, there is provided at the inbound region at the balustrade panel 2 a handrail support member or profile 3 which deviates or is offset from the lengthwise or longitudinal axis of the associated panel or plate 2.

Figure 4:
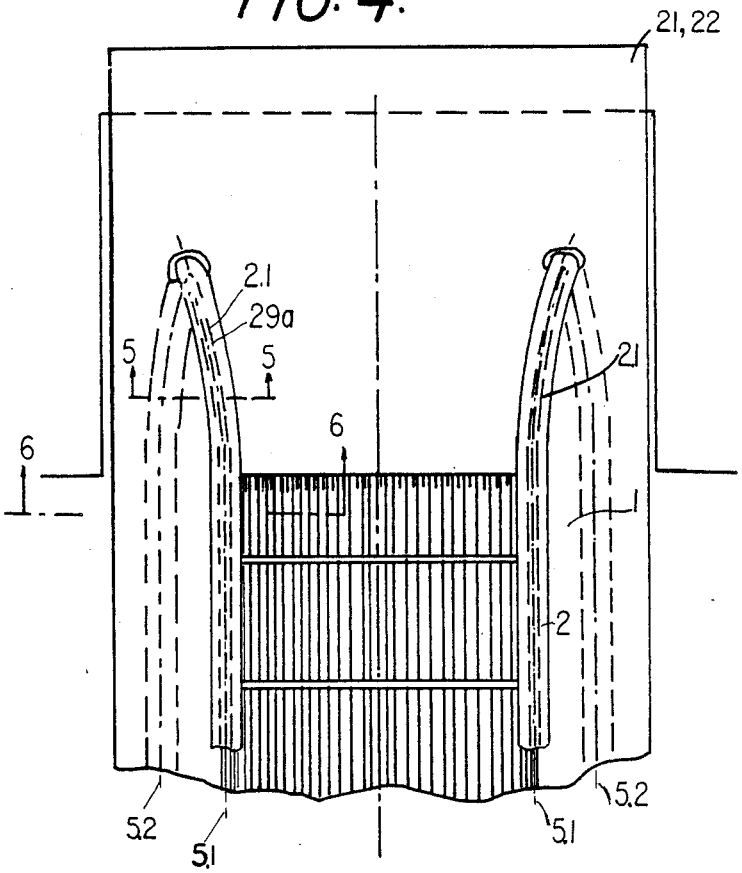
FIG. 4 is a fragmentary top plan view of a modified construction of transportation or transport apparatus depicting details at one end or terminal region thereof where the handrail undergoes deflection or turning for its return travel.
Figure 5A:
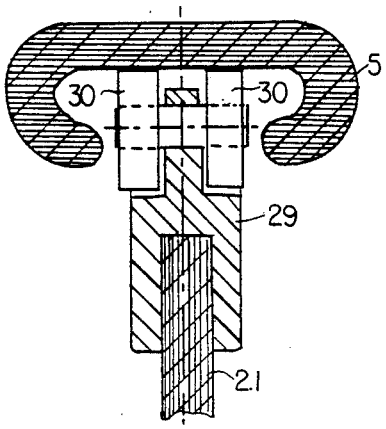
FIG. 5*a* is an enlarged cross-sectional view of the modified embodiment of transportation or transport apparatus depicted in FIG. 4, taken substantially along the section line 5—5 thereof.
Figure 5B:
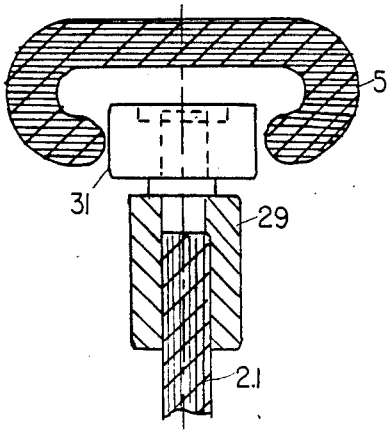
FIG. 5*b* likewise is an enlarged cross-sectional view of the transportation or transport apparatus depicted in FIG. 4, with the section being taken slightly forward of the section line 5—5 of FIG. 4 as viewed in the direction of the terminal reversing or turning end region of the related balustrade.
Figure 6:
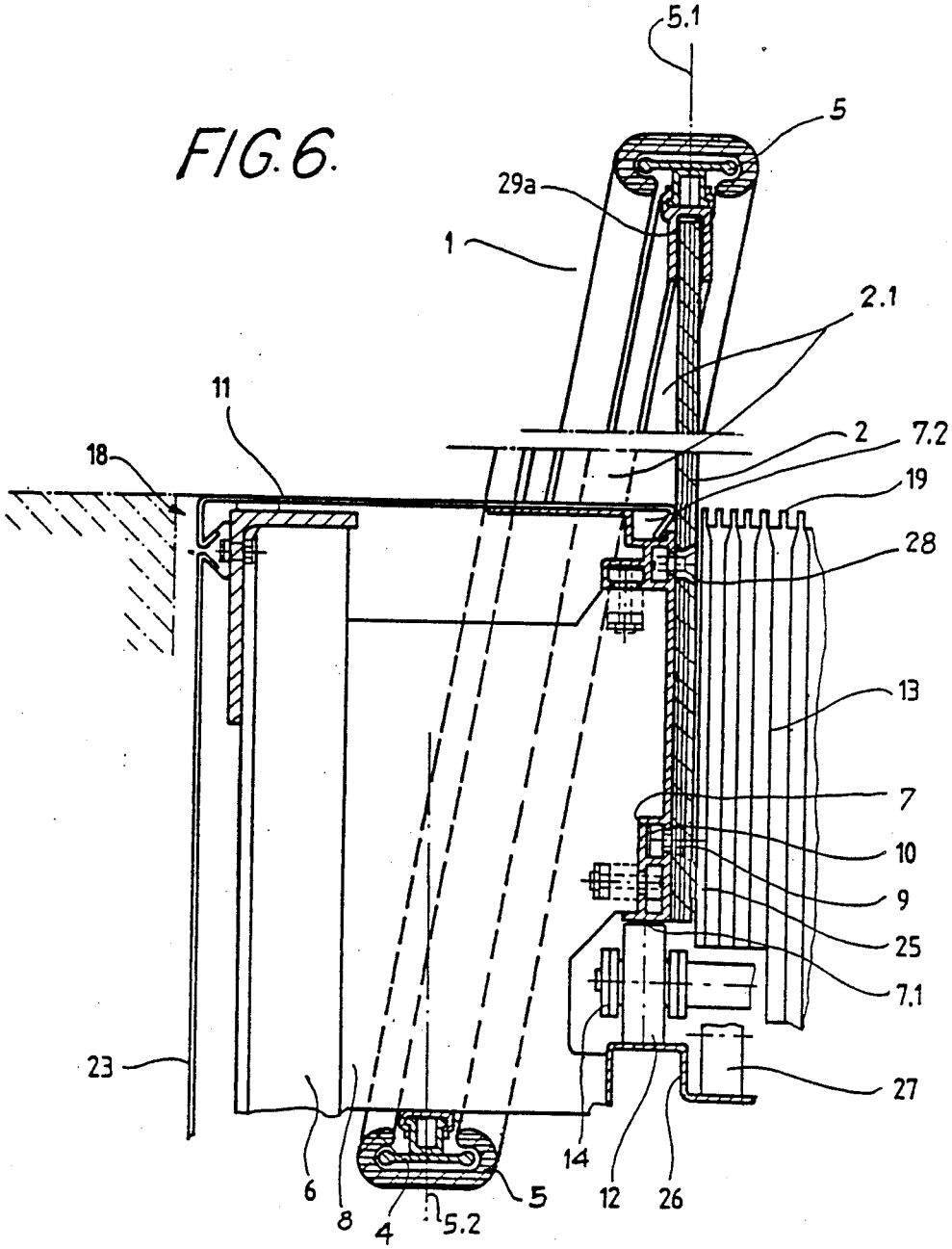
FIG. 6 is an enlarged cross-sectional view of the transportation or transport apparatus depicted in FIG. 4, taken along the section line 6—6 thereof through the balustrade and the balustrade deck at the region of reversal of the travel direction of the handrail.

However, a different possibility and thus modified embodiment has been shown in FIGS. 4 to 6. Thus, it is also readily possible and conceivable, instead of using the balustrades 1 depicted in FIGS. 2 and 3 which are provided with the handrail support members or profiles 3 deviating from or inclined with respect to the associated panel axis, to guide each handrail 5, which is here equipped with a symmetrical handrail support member or profile 29, centrally upon the associated balustrade panel 2 and to guide the handrail 5 at the region of the upper and the lower balustrade end or terminal regions defining the turning or deflection locations by means of there located outwardly curved or convex bent or rounded balustrade panel portions 2.1 and equally the associated outwardly curved or convex bent or rounded handrail support member or profile portion **29*a*, as best recognized by referring to FIGS. 4 and 6. It will be observed that with this design the return run of the handrail then is generally located and travels in a plane 5.2 which is laterally outwardly offset and substantially parallel to the plane 5.1 in which there is located and travels the inbound or forward travelling upper run of the handrail 5. The return motion of the handrail 5, in other words, at its return run, is possible externally of the associated support member or profile 7 and within the outer balustrade deck or sill 18. Furthermore, with this embodiment in order to reduce the friction there is provided an assembly or battery of deflection or turning rolls 30, 31 accommodated to the required convex deviation or outward curvature of the handrail 5 at such end or terminal turning or deflection regions. In particular, the support profile or member 29 will be seen to rotatably support the deflection rolls 30 which rotate about a substantially horizontal rotational axis and equally the deflection rolls 31 which rotate about a substantially vertical or upright rotational axis. In this way there is ensured for the reliable outward or convex deflection of the corresponding handrail 5 at the turning or reversal locations at each end or terminal region of the balustrade and the shifting of the inbound or forward travelling run of the handrail 5 from the substantially vertical or upright central longitudinal plane 5.1 to the outwardly located or shifted likewise substantially vertical or upright central longitudinal plane 5.2 where there travels the return run of the handrail 5**.

At the upper flexed part of the support member or profile 7 there is afforded the possibility by virtue of the provision of the lengthwise or longitudinal channel 7.2 to illuminate the balustrade from the outer balustrade deck or sill 18. Since the step band 15 in the case of escalators 20 or the tread plate band in the case of moving passenger walkways is arranged offset in relation to the outer balustrade deck or sill 18, in the case of glass balustrades the step front edges or noses 19 or the upper parts of the tread plates which are visible from the outside, additionally can be irradiated and illuminated. In this way there will be indicated to a potential passenger located at a distance from the transport apparatus in an even more visually discernible manner the direction in which the step band 15 or the plate band is moving and in which direction the passenger must move in order to reach a lower landing or a higher landing.

While there is shown and described present preferred embodiments of the invention, it is to be distinctly understood that the invention is not limited thereto, but may be otherwise variously embodied and practiced within the scope of the following claims. ACCORDINGLY,

What I claim is:

1. A balustrade for a transportation apparatus, especially an escalator or a moving passenger walkway, comprising:

a support body member;

two spaced apart oppositely disposed balustrade side walls;

said two spaced apart oppositely disposed balustrade side walls being supported inwardly of the support body member;

each balustrade side wall being provided with a movable handrail;

endless revolvingly driven transport means arranged between said balustrade side walls;

outer cover means mounted at said support body member laterally outwardly of said two spaced apart oppositely disposed balustrade side walls;

said outer cover means having two oppositely disposed sides associated with respective ones of said two spaced apart oppositely disposed balustrade side walls;

outer deck cover means of said outer cover means being arranged at both of said two oppositely disposed sides of said outer cover means;

said balustrade side walls being arranged substantially in upright disposition;

balustrade panel means provided for each one of said balustrade side walls and defining glass plates;

said balustrade panel means laterally guiding said endless revolvingly driven transport means;

said endless revolvingly driven transport means being provided with thread element means having a predetermined width;

said balustrade panel means being spaced from one another at a distance which is slightly greater than the predetermined width of the tread element means;

said endless revolvingly driven transport means having a treadable forward run as viewed in a transport direction of the transportation apparatus; and said threadable forward run of said endless revolvingly driven transport means being arranged such as to protrude above the outer deck cover means and to be visible through said glass plates defining said balustrade panel means of said two spaced apart oppositely disposed balustrade side walls.

2. The balustrade arrangement as defined in claim 1, wherein:

said tread element means comprises a tread band member.

3. The balustrade arrangement as defined in claim 2, wherein:

said thread band member comprising a step band.

4. The balustrade arrangement as defined in claim 3, wherein:

said step band contains a plurality of steps.

5. The balustrade arrangement as defined in claim 2, further including:

support profile members arranged at said support body member for supporting associated balustrade panel means;

each balustrade panel means being secured at its associated support profile member;

said support profile members supporting respective ones of said outer deck cover means;

handrail guide means provided for guiding said movable handrail at each balustrade side wall and including a return portion for guiding a return run of the associated handrail;

each said support profile member receiving the return portion of the associated handrail guide means;

said tread band member including chain rolls;

upper counter guide means provided for said chain rolls; and said support profile member forming said upper counter guide means for the chain rolls of said tread band member.

6. The balustrade arrangement as defined in claim 5, wherein:

each said support profile member comprises a longitudinal channel capable of receiving lighting elements and light translucent cover elements.

7. The balustrade arrangement as defined in claim 1, further including:

handrail support profile means provided for each handrail;

each said handrail support profile means being arranged upon an associated balustrade panel means; and each of said handrail support profile means being displaceably offset for shifting the associated handrail laterally out of a first plane determined by a substantially vertical central axis of the associated balustrade panel means into a second plane substantially parallel to said first plane.

8. The balustrade arrangement as defined in claim 1, further including:

handrail support profile means provided for each balustrade panel means and supporting an associated handrail;

said handrail support profile means supporting the associated handrail at the threadable forward run of the endless revolvingly driven transport means in a plane determined by a substantially vertical central axis of the associated balustrade panel means;

each said handrail having upper and lower handrail deflection portions; and deflection means arranged at the upper and lower handrail deflection portions and serving for placing the associated handrail into a laterally shifted parallel return plane.

9. The balustrade arrangement as defined in claim 8, wherein:

said deflection means comprises a convex bent portion of the associated balustrade panel means bent outwardly away from said endless revolvingly driven transport means and includes a return portion and an assemblage of deflection rolls.

10. The balustrade arrangement as defined in claim 8, wherein:

said deflection means comprises a handrail support profile means including an assemblage of deflection rolls.

11. A balustrade for a transportation apparatus, comprising:

a support body member;

at least one balustrade side wall having an outer side;

said at least one balustrade side wall being supported by its outer side at an inner side of the support body member;

each balustrade side wall being provided with a movable handrail;

driven transport means arranged adjacent said at least one balustrade side wall remote from its outer side;

outer cover means mounted at said support body member;

at least one outer deck cover means of said outer cover means extending from said support body member to said outer side of said at least one balustrade side wall;

said at least one balustrade side wall being arranged substantially in upright disposition;

balustrade panel means provided for said at least one balustrade side wall;

said balustrade panel means laterally guiding said driven transport means;

said driven transport means being provided with tread element means;

said balustrade panel means being spaced in neighboring relationship with respect to said tread element means;

said driven transport means having a treadable forward run as viewed in a transport direction of the transportation apparatus; and said forward run of said driven transport means being arranged such as to protrude above the outer deck cover means.

* * * * *